US010728664B2

(12) United States Patent
Granicki

(10) Patent No.: US 10,728,664 B2
(45) Date of Patent: Jul. 28, 2020

(54) BALANCED ARMATURE DRIVER ASSEMBLY

(71) Applicant: CUSTOM ART SP Z.O.O., Bialystok (PL)

(72) Inventor: Piotr Granicki, Bialystok (PL)

(73) Assignee: CUSTOM ART SP Z.O.O., Bialystok (PL)

( * ) Notice: Subject to any disclaimer, the term of this patent is extended or adjusted under 35 U.S.C. 154(b) by 0 days.

(21) Appl. No.: 16/320,577

(22) PCT Filed: Jul. 27, 2017

(86) PCT No.: PCT/EP2017/069080

§ 371 (c)(1),
(2) Date: Jan. 25, 2019

(87) PCT Pub. No.: WO2018/019963

PCT Pub. Date: Feb. 1, 2018

(65) Prior Publication Data

US 2019/0273989 A1 Sep. 5, 2019

(30) Foreign Application Priority Data

Jul. 29, 2016 (FR) ..... 16 57398

(51) Int. Cl.
*H04R 3/08* (2006.01)
*H04R 11/02* (2006.01)
*H04R 1/10* (2006.01)

(52) U.S. Cl.
CPC ..... *H04R 3/08* (2013.01); *H04R 11/02* (2013.01); *H04R 1/1016* (2013.01)

(58) Field of Classification Search
CPC ..... H04R 3/08; H04R 1/1016; H04R 11/02; H04R 11/00; H04R 3/14; H04R 2209/00; H04R 2209/041; H04R 9/00; H04R 9/047
See application file for complete search history.

(56) References Cited

U.S. PATENT DOCUMENTS 2,380,869 A 7/1945 Quam
8,858,419 B2 * 10/2014 Puria ..... H04R 11/02 600/25
2003/0063761 A1 * 4/2003 Hlibowicki ..... H04R 3/14 381/111

(Continued)

FOREIGN PATENT DOCUMENTS

JP 2011040933 A 2/2011

OTHER PUBLICATIONS

Sonion: "Data Sheet Receiver 2389", Jan. 20, 2015 (Jan. 20, 2015). XP055358331. Retrieved from the Internet: URL: http://www.sonion.com/wp/wp-content/uploads/2389-3002874.pdf [retrieved on Mar. 23, 2017].

*Primary Examiner* — Jason R Kurr
(74) *Attorney, Agent, or Firm* — Volpe and Koenig, P.C.

(57) ABSTRACT

A balanced armature driver assembly comprises a first balanced armature driver having an armature surrounded by a coil, said first balanced armature driver having two taps for connecting respective end points (12,14) of said coil to an input signal circuit. The coil further comprises an intermediate point (16) which is electrically connected to one of said respective end points (12,14) such that the coil is shorted (16) between said intermediate point and said one of said respective points (12,14).

15 Claims, 7 Drawing Sheets

(56) References Cited

U.S. PATENT DOCUMENTS

Figure 1:
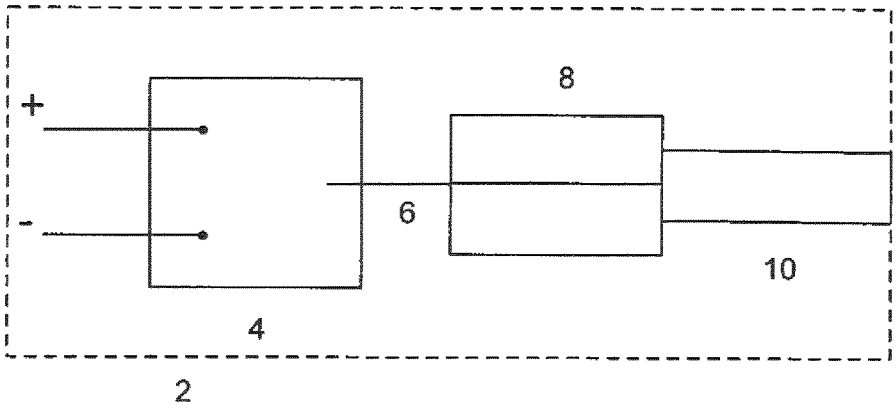

| | | | | |
|---|---|---|---|---|
| 2006/0008110 | A1 | 1/2006 | Van Halteren | |
| 2012/0008814 | A1* | 1/2012 | Alwicker | H04R 1/1058 381/380 |
| 2013/0089232 | A1* | 4/2013 | Kim | H04R 17/00 381/431 |
| 2013/0101149 | A1* | 4/2013 | Maenpaa | H04B 5/0006 381/331 |

* cited by examiner

BALANCED ARMATURE DRIVER ASSEMBLY

The invention concerns the field of in-ear audio, and particularly the field of balanced armature driver based devices.

The field of balanced armature driver speakers (also called in-ear monitors, or IEMs) has known an extraordinary development in the past twenty years. They have allowed delivering high fidelity like qualities with extremely high sensitivity, allowing for great portable use. As a result, IEMs have greatly developed their scope of use, from on stage monitoring to audiophiles.

Initially, IEMs contained a single driver, generally of the balanced armature type, responsible for covering the full audio spectrum. Progressively, IEMs were produced with several drivers, allowing for better quality of reproduction. The development of IEMs has been accompanied with the development of better digital sound sources, in particular better digital audio players (also known as DAPs).

Among the technical challenges that have emerged in the past years is the effect of the output impedance of the headphone amplifiers in digital audio players which influences the quality of the sound reproduction by an IEM, negatively affecting the reproduction of bass band frequencies.

It is generally accepted that the impedance of an IEM must be at least eight times that of the output impedance of a DAP in order to not alter the rendering of the music by the IEM.

This means that customers are restricted to either buying DAPs with very low impedance in order to have a great choice of IEMs, or are restricted to a very limited set of IEMs with sufficient impedance when the output impedance is high, with the added issue that high impedance IEMs require more power from portable sound sources to achieve like sound pressure levels (SPL), which increases battery drain. Typically, it is considered that smartphones are not fit for powering IEMs with impedance above 100 ohms.

The invention aims at improving the situation. This is achieved by a balanced armature driver assembly, comprising a first balanced armature driver having an armature surrounded by a coil, said first balanced armature driver having two taps for connecting respective end points of said coil to a cabling having a positive signal cable and a negative signal cable, and the coil further comprises an intermediate point which is electrically connected to one of said respective end points such that the coil is shorted between said intermediate point and said one of said respective points.

This balanced armature assembly is advantageous because it is essentially insensitive to the output impedance of the sound amplifier to which it is connected. The Applicant has discovered that this is surprisingly achieved because the balanced armature according to the invention essentially acts as a resistance, whereas they act essentially inductively in convention assemblies.

In other embodiments, the balanced armature assembly may have one or more of the following features:

the balanced armature assembly further comprises a second balanced armature driver having an armature surrounded by a coil, said second balanced armature driver having three taps for connecting respective end points of said coil and/or an intermediate point to the cabling, said first balanced armature driver and said second balanced armature driver being cabled such that a high pass filter is achieved at the first balanced armature driver output, the intermediate point of the first balanced armature driver is electrically connected to the end point which is connected to the negative signal cable of the cabling, the other end point of the first balanced armature driver is wired to an end point of the second balanced armature driver, the intermediate point of the second balanced armature driver being connected to the negative signal cable of the cabling, and the other end point of the second balanced armature driver being connected to the positive signal cable of the cabling, the balanced armature assembly further comprises a capacitor placed in series between the other end point of the first balanced armature driver and the end point of the second balanced armature driver, the other end point of the first balanced armature driver is wired to the intermediate point of the second balanced armature driver with a capacitor placed in series between them, an end point of the second balanced armature driver is connected to the negative signal cable of the cabling, and the other end point of the second balanced armature driver is connected to the positive signal cable of the cabling, the balanced armature assembly further comprises a second balanced armature balanced armature driver having an armature surrounded by a coil, said second balanced armature driver having three taps for connecting respective end points of said coil and/or an intermediate point to the cabling, and said first balanced armature driver and said second balanced armature driver are cabled such that a low pass filter is achieved at the first balanced armature driver output, the intermediate point of the first balanced armature driver is electrically connected to the end point which is connected to the positive signal cable of the cabling, the other end point of the first balanced armature driver is connected to an end point of the second balanced armature driver, the other end point of the second balanced armature driver is connected to the positive signal cable of the cabling, and the intermediate point of the second balanced armature driver is connected to the negative signal cable of the cabling, the other end point of the first balanced armature driver and the intermediate point of the second balanced armature driver are connected to the negative signal cable of the cabling, an end point of the second balanced armature driver is connected to the positive signal cable of the cabling, and the other end point of the second balanced armature driver is connected in series with a capacitor to the intermediate point of the first balanced armature driver and the end point which is connected to the positive signal cable of the cabling, a resistor being further placed in series between the positive signal cable of the cabling and the intermediate point of the first balanced armature driver, the balanced armature driver assembly further comprises a second balanced armature driver having an armature surrounded by a coil, said second balanced armature driver having three taps for connecting respective end points (12,14) of said coil and/or an intermediate point to the cabling, and said first balanced armature driver and said second balanced armature driver are cabled such that a band pass filter is achieved at the first balanced armature driver output, an end point of the second driver is connected to the negative signal cable of the cabling, the intermediate point of the first driver is electrically connected to the end point which is connected to the positive signal cable of the cabling, the intermediate point of the second balanced armature driver is further connected to the positive signal cable of the cabling, and the other end points (14, 24) of the first driver and the second driver are wired together and are connected to the positive signal cable of the cabling with a capacitor placed in series, the first driver has three taps each connected to one of the respective end points of the coil and the intermediate point, and the electrical connection such that the coil is shorted between said intermediate point and said one of said respective points (12, 14) is realized by electrical wiring of the corresponding taps, the first driver has two taps each connected to one of the respective end points of the coil, and the electrical connection such that the coil is shorted between said intermediate point and said one of said respective points (12, 14) is realized internally to the coil, and the balanced armature driver assembly further comprises an input circuit for an input signal, the positive signal cable and the negative signal cable of the cabling being respectively coupled to a positive output and a negative output of the input circuit.

Figure 2:
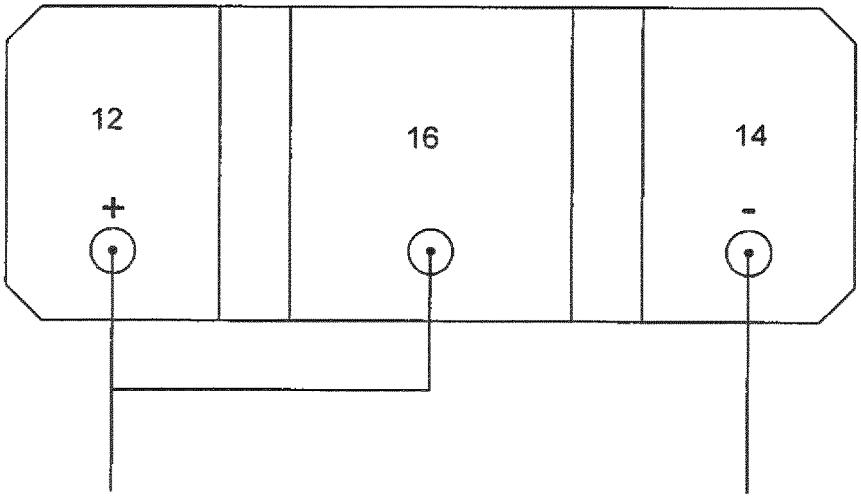
Figure 3:
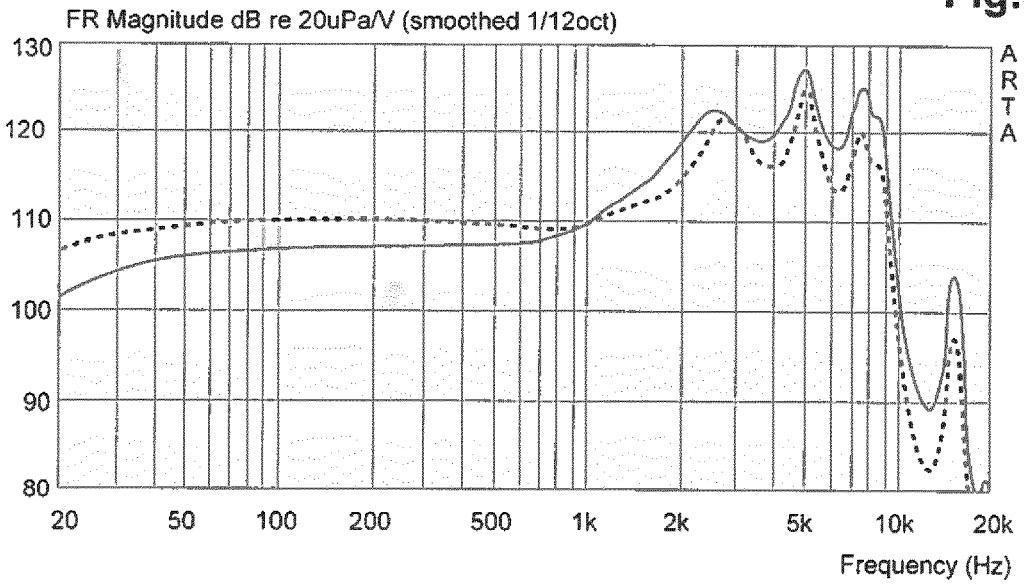
Figure 4:
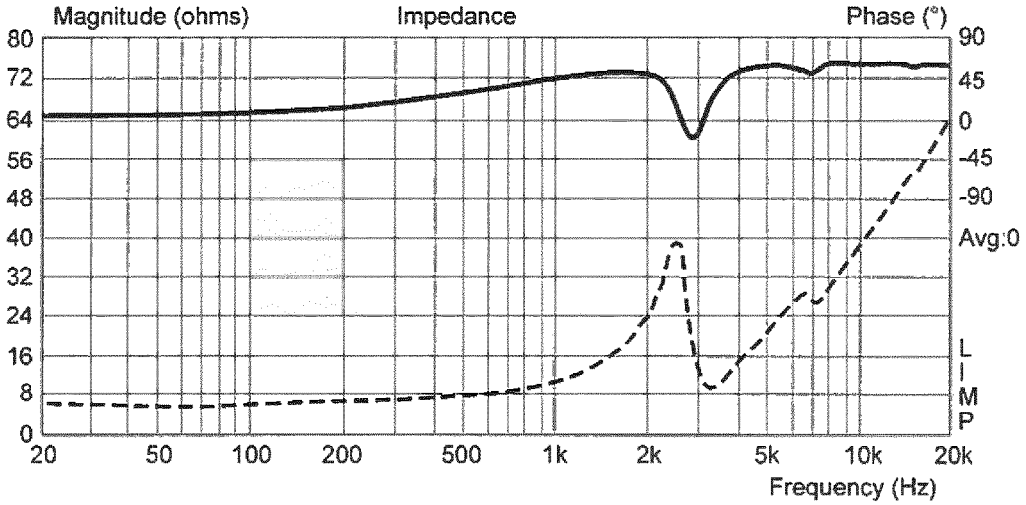
Figure 5:
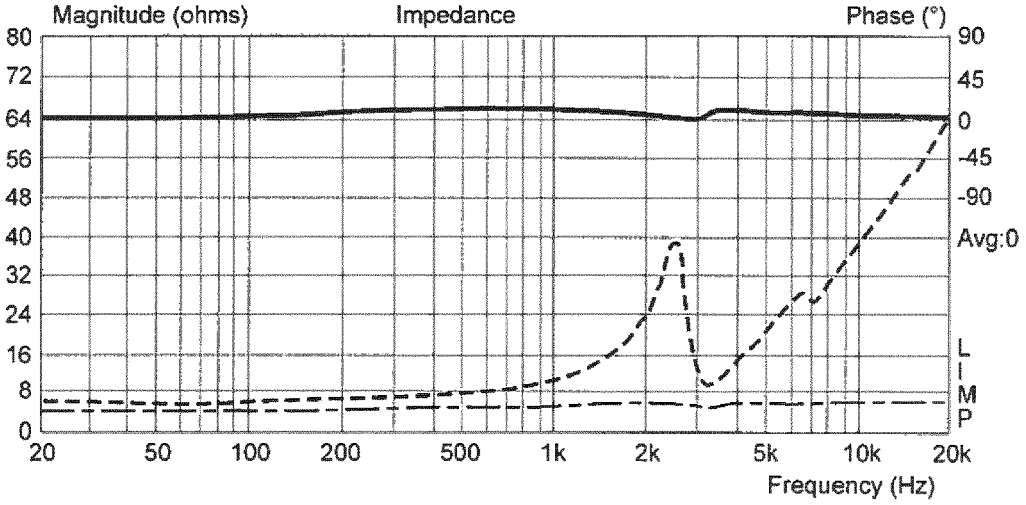
Figure 6:
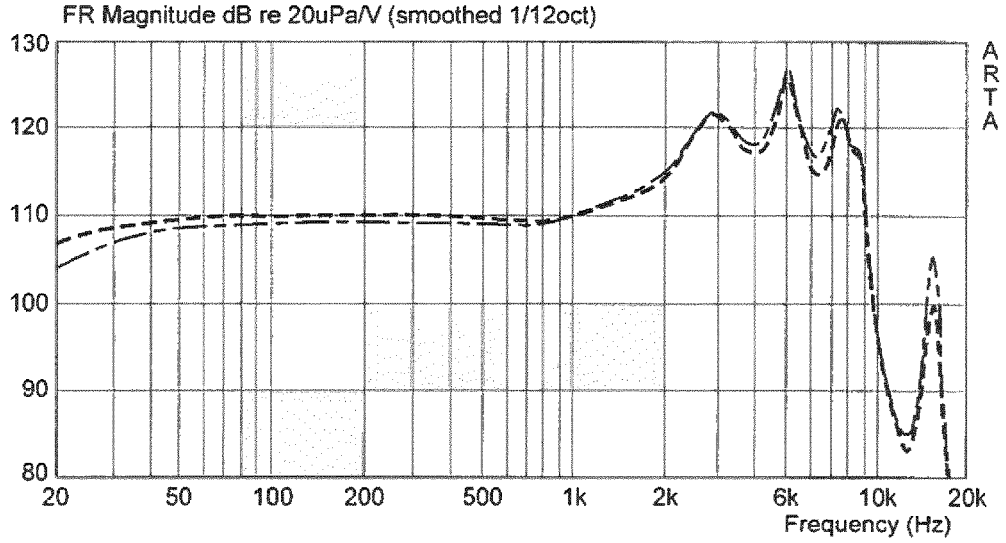
Figure 7:
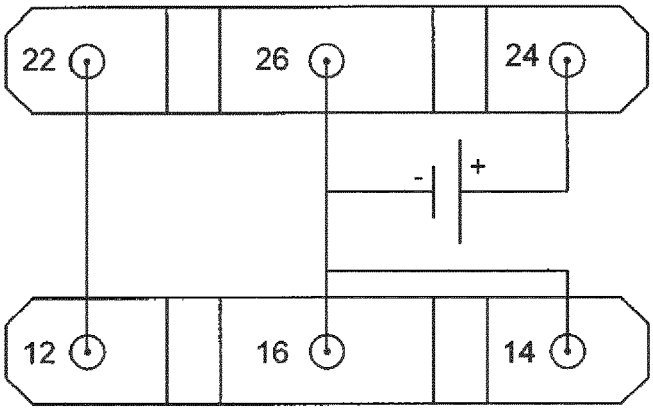
Figure 8:
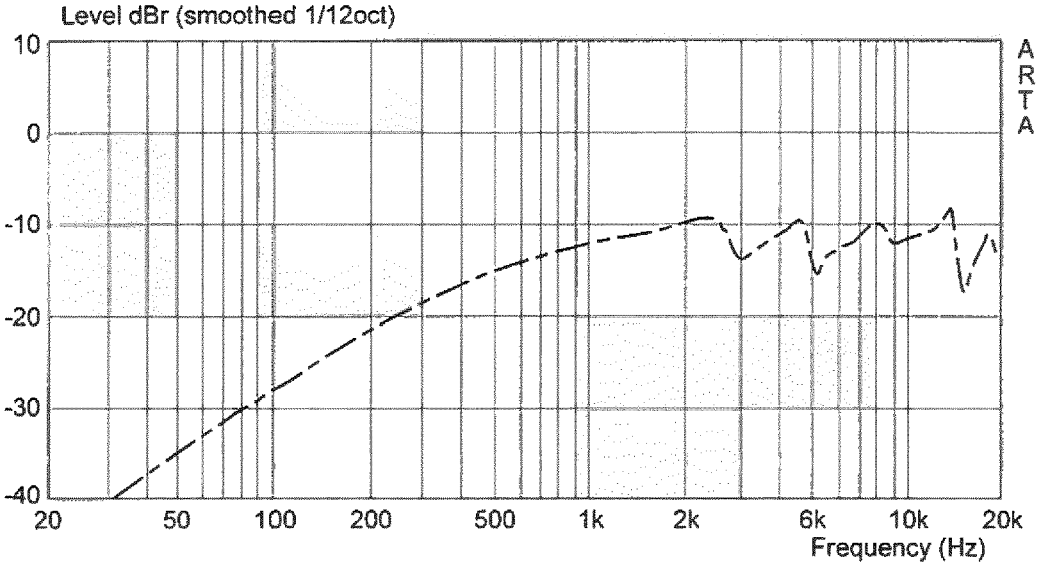
Figure 9:
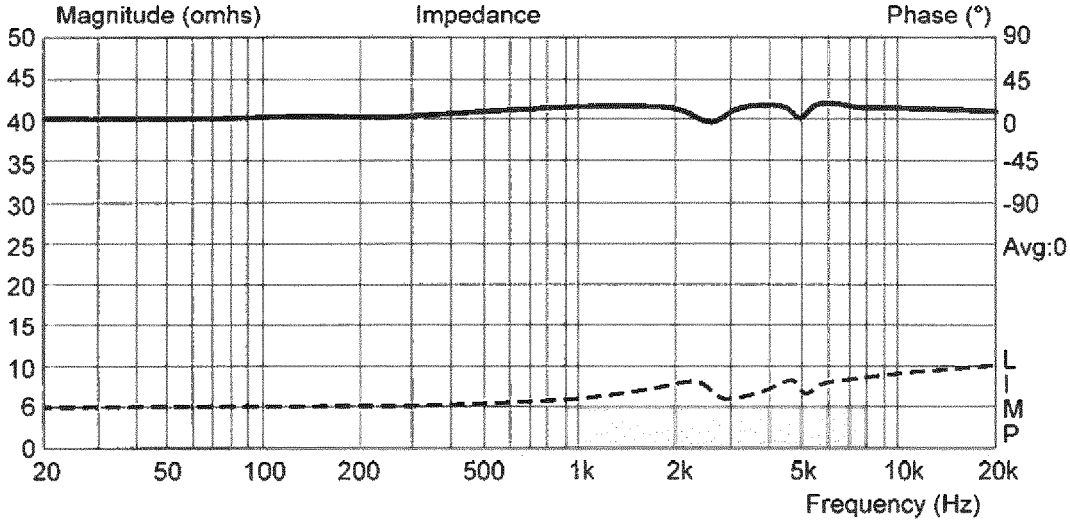
Figure 10:
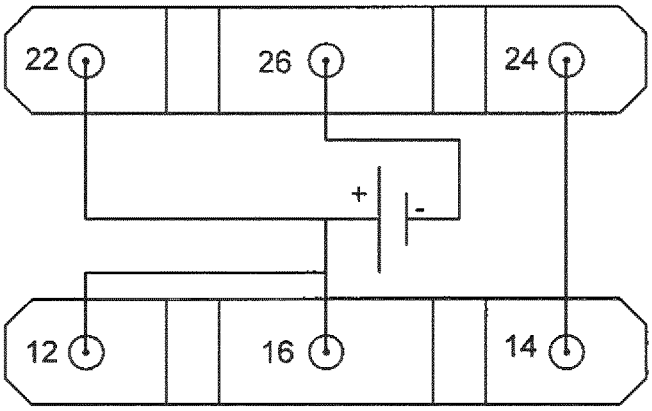
Figure 11:
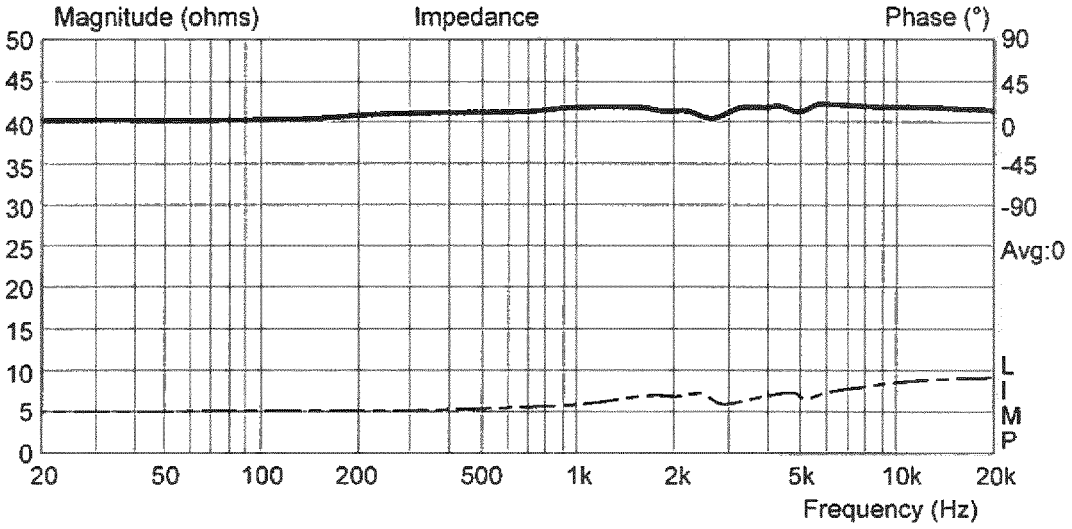
Figure 12:
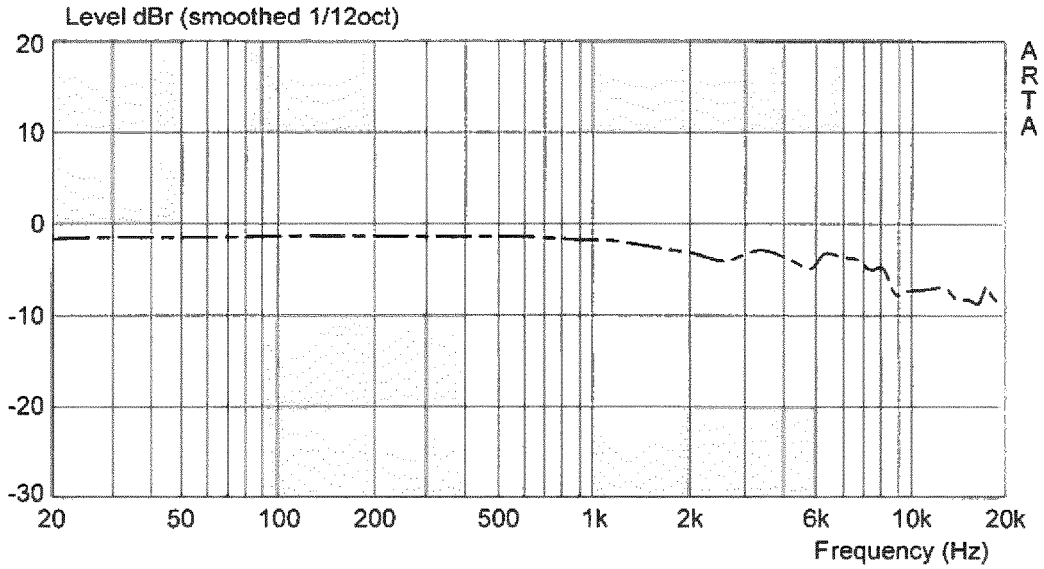
Figure 13:
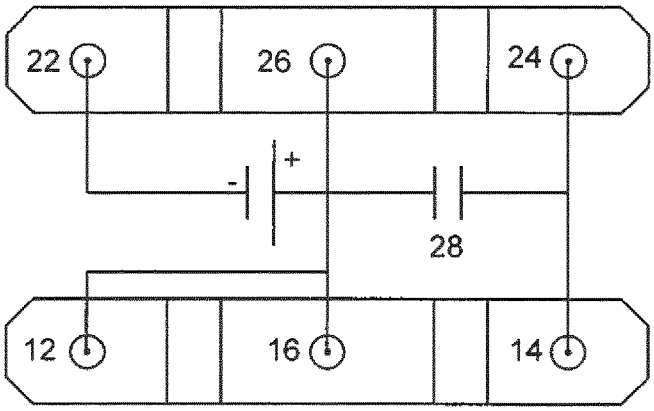
Figure 14:
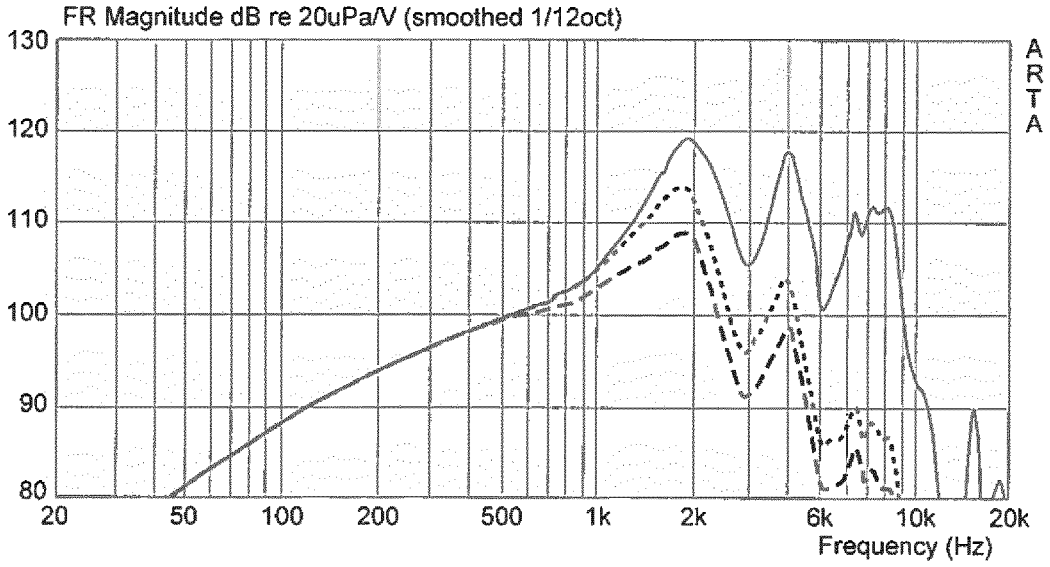
Figure 15:
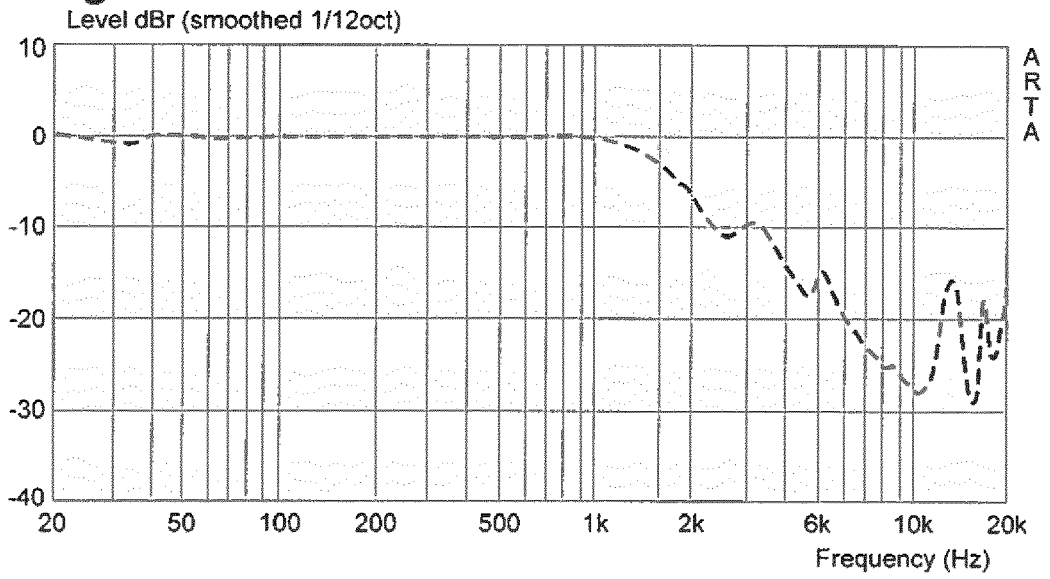
Figure 16:
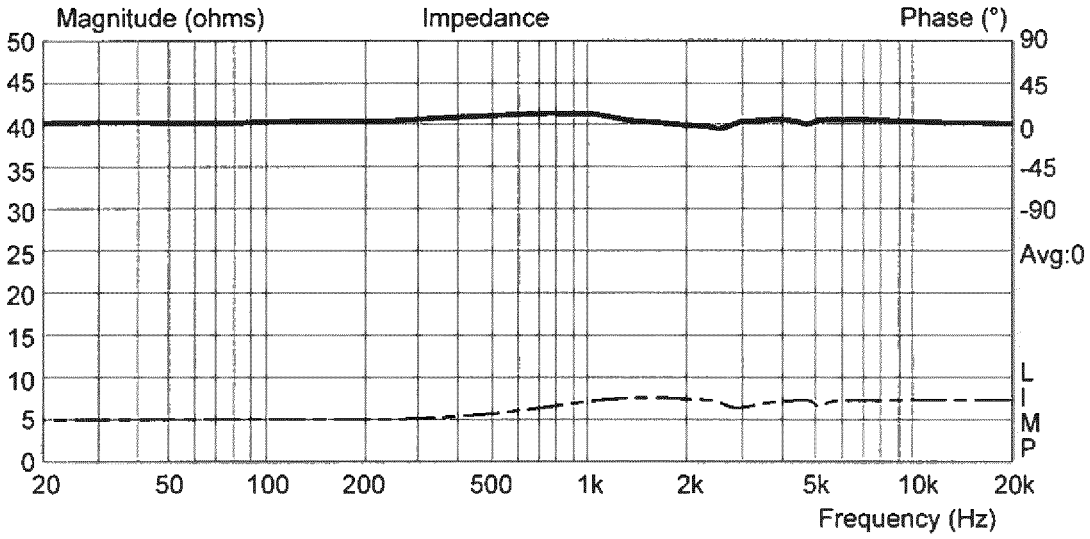
Figure 17:
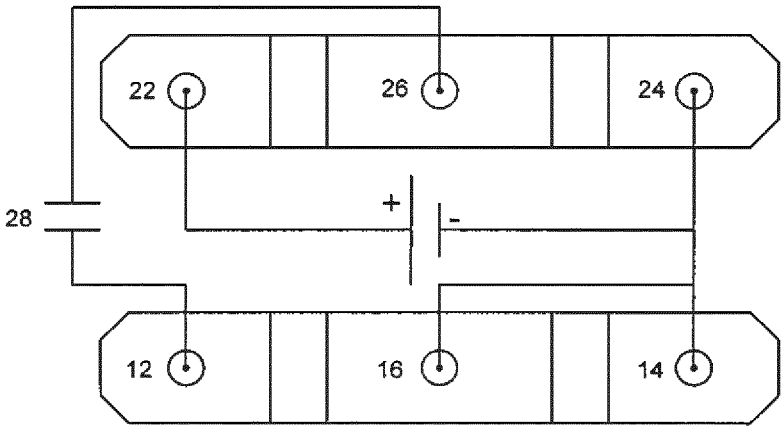
Figure 18:
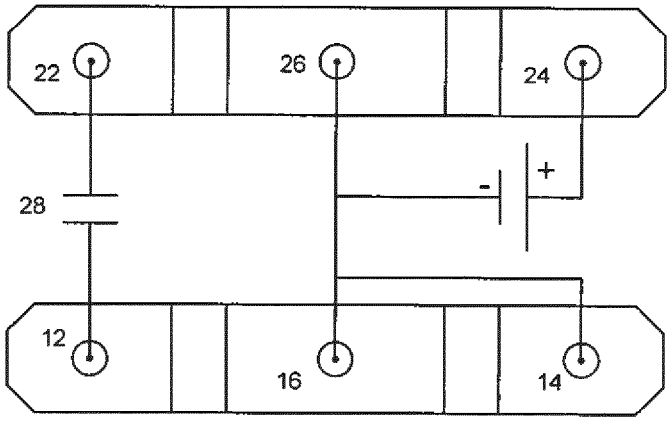
Figure 19:
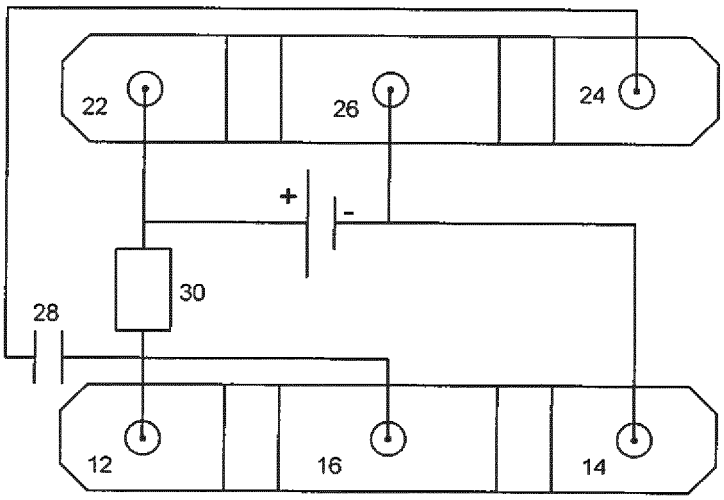

Other features and advantages of the invention will appear when reading the following specification of the drawings which embodies examples given by way of illustration in a non-limiting manner, and on which:

FIG. 1 is a generic view of an IEM comprising a balanced armature assembly according to the invention, FIG. 2 shows a close-up view of the cabling of the balanced armature assembly of FIG. 1, FIG. 3 shows a frequency response of a balanced armature driver cabled conventionally when connected to a high output impedance sound source, and when connected to a low output impedance sound source, FIG. 4 shows an impedance and phase curve of the balanced armature driver of FIG. 3 when cabled conventionally, FIG. 5 shows an impedance and phase curve of the balanced armature driver of FIG. 3 when cabled according to FIG. 2, as well as the impedance curve of FIG. 4, FIG. 6 shows the frequency response of the balanced armature driver of FIG. 3 when cabled according to FIG. 2, when connected to a high output impedance sound source, and when connected to a low output impedance sound source, FIG. 7 shows a generic view of a balanced armature assembly comprising a high-pass filter with a balanced armature driver cabled according to FIG. 2, FIG. 8 shows the difference in frequency response at the first driver output in the balanced armature assembly of FIG. 7 and at the first driver output when cabled conventionally, FIG. 9 shows an impedance and phase curve of the balanced armature assembly of FIG. 7, FIG. 10 shows a generic view of a balanced armature assembly comprising a low-pass filter with a balanced armature driver cabled according to FIG. 2, FIG. 11 shows an impedance and phase curve of the balanced armature assembly of FIG. 10, FIG. 12 shows the difference in frequency response at the first driver output in the balanced armature assembly of FIG. 10 and at the first driver output in a balanced armature assembly of FIG. 10 with the first driver being cabled conventionally, FIG. 13 shows a generic view of a balanced armature assembly comprising a band-pass filter with a balanced armature driver cabled according to FIG. 2, FIG. 14 shows the frequency response at the first driver output between the balanced armature assembly of FIG. 13 with various capacitor values, FIG. 15 shows the difference in frequency response between the two higher curves of FIG. 14, FIG. 16 shows an impedance and phase curve of the balanced armature assembly of FIG. 13, FIGS. 17 and 18 show other generic views of a balanced armature assembly comprising a high-pass filter with a balanced armature driver cabled according to FIG. 2, and FIG. 19 shows another generic view of a balanced armature assembly comprising a low-pass filter with a balanced armature driver cabled according to FIG. 2.

The drawings and the following specification contain, for the most part, elements of tangible nature. They will thus not only serve to help better understand the invention, but may also contribute to its definition.

FIG. 1 shows a generic view of an IEM comprising a balanced armature assembly 2 according to the invention, and FIG. 2 shows a close-up of the cabling of this balanced armature assembly 2.

The balanced armature assembly 2 comprises an input circuit 4 which receives the audio input cables from a sound source, a cabling assembly 6, a balanced armature driver 8 and a sound tube 10.

The input circuit 4 processes the input audio signal and adapts it in view of the downward circuitry. In some instances, the input circuit 4 may be a crossover circuit which processes the audio signal to divide into multiple frequency bands fed into separate balanced armature drivers, so that each one works into a specified frequency band. The cabling assembly 6 has a positive signal cable and a negative signal cable which connect the input circuit 4 to the balanced armature driver 8, the output of which is connected to the sound tube 10. The sound tube 10 is the part which is input in the user's ear to transmit the sound. In some embodiments, particularly where the balanced armature assembly 2 comprises a single balanced armature driver, the input circuit 4 maybe omitted and only cabling 6 remains.

In the following, the balanced armature driver 8 will also be referred to as driver 8. In the example described herein, the driver 8 is a 2389 receiver made by Sonion (registered trademark). This type of driver is known a "three-taps" driver. As shown on FIG. 2, this means that the cabling 6 may be connected at three different points, each of which is connected to a specific portion of the coil of the driver 8:

- a first tap 12, located at the leftmost part of FIG. 2, which is connected to an extremity of the coil of the driver 8,
- a second tap 14, located at the rightmost part of FIG. 2, which is connected to the other extremity of the coil of the driver 8, and
- a third tap 16, located between the first tap 12 and the second tap 14, and which is connected to the middle of the coil of the driver 8.

In a conventional balanced armature driver assembly, the cabling 6 will be connected to two of the three taps (that is either to first and second, first and third or second and third), in order to adjust the sonic frequency response of the driver 8. Indeed, if the cabling 6 is connected to the third tap, then the signal is only passing through half of the coil, hence changing the sound injected in the sound tube 10.

According to the invention, the cabling 6 is arranged in a different manner:

the first tap 12 is connected to the positive signal cable of the cabling 6 which is connected to the positive output of the input circuit 4, the second tap 14 is connected to the negative signal cable of the cabling 6 which is connected to the negative output of the input circuit 4, and the third tap 16 is connected to the first tap 12, thereby creating a short between the first tap 12 and the third tap 16.

This arrangement is extremely unconventional, because shorts are conventionally avoided. The Applicant has not only discovered that it causes no problem in this arrangement, but it also provides significant advantages which will be detailed below with reference to FIGS. 3 to 5.

FIG. 3 shows a frequency response of the 2389 driver used in FIGS. 1 and 2, when cabled conventionally, being connected to a high output impedance sound source, and when connected to a low output impedance sound source.

As appears on these graphs, the 2389 driver response changes greatly, depending on the impedance of the sound source. The frequency response which is measured when connected to a high output impedance sound source is that which is lower under 1 kHz, and higher over 1 kHz, whereas the frequency response which is measured when connected to a low output impedance sound source is that which is higher under 1 kHz and lower over 1 kHz.

As a result, when connected to a high impedance source, the 2389 driver will provide a sound with a lot less bass and up to mediums frequencies (between 20 Hz and 500 Hz, the frequency response difference is between 3 dB and 6 dB), and with significantly more high frequencies (over 3.5 kHz, the frequency response difference is between 3 dB and 8 dB) than when connected to a low impedance source.

FIG. 4 shows an impedance and phase curve of the 2389 driver when cabled conventionally. It appears clearly that the impedance of the driver varies greatly depending on the frequency of the input signal, from around 8 ohms between 10 Hz and about 1 kHz, with a peak at 40 ohms around 2.5 kHz, and then a ramp from 8 ohms at 3 kHz up to 64 ohms at 20 kHz. The more the impedance varies, the more the frequency response of a driver will be sensitive to the output impedance of the sound source, as shown by FIG. 3.

The corresponding phase curve is a ramp from 0° at 20 Hz up to 45° at 2 kHz, with a dip to −15° at 3 kHz and then a plateau at about 60° until 20 kHz. The phase angle determines how much the current will lead or lag the voltage waveform in a reactive circuit. In an inductive circuit, the current will lag behind the voltage, and the phase angle will be positive. In a capacitive circuit, the current will lead the voltage, and the phase angle will be negative. This means that this driver will have a varying nature (close to resistor at 20 Hz, then inductive at 2 kHz, capacitive at 3 kHz then capacitive again), which will cause issues in multi-driver setups.

FIGS. 3 and 4 show a typical problem encountered with balanced armature driver assemblies: depending on the output impedance of the sound source to which the balanced armature driver is connected, the sound output will be completely different.

This means that users have a very hard time finding the combination of a satisfying source with the balanced armature driver assembly of their liking, when they can find one at all. And on the designer side, this means that there is an extremely high unpredictability in the customers' opinions, since it is unclear to which extent the impedance of their DAP will influence the sound output.

FIG. 5 shows the impedance curve of the 2389 driver when cabled according to FIG. 2, as well as its phase curve. The impedance curve of the 2389 driver when cabled conventionally has been added for comparison.

In the arrangement according to the invention, the 2389 driver exhibits an almost flat impedance—it varies from about 4 ohms at 20 Hz to about 7 ohms at 20 kHz, and the phase frequency response is nearly flat, between 0° and 10° at the maximum. As seen above, the near 0° phase means that the driver will behave essentially as a resistor.

These results are unheard of in existing balanced armature assemblies, and enable to provide balanced armature assemblies which will sound nearly identical on all types of output impedance sound sources, as shown by FIG. 6, which shows the frequency response of the 2389 cable according to FIG. 2 when connected to a high output impedance sound source (lower under 1 kHz, and higher over 1 kHz) and when connected to a low output impedance sound source (higher under 1 kHz, and lower over 1 kHz). These curves show that this balanced armature driver assembly will sound nearly the same in both cases.

The Applicant has discovered that the benefits of this cabling extend beyond the impedance and phase uniformity achievements. In fact, when used in multiple balanced-driver assemblies, the Applicant has discovered that the invention allows executing high pass filters and band filters in a way unknown before.

This is groundbreaking because high pass filters and band pass filters are traditionally intended to make use of specific regions of the frequency responses of drivers, in order to combine the best abilities of all drivers of a multi-driver assembly.

The only way known to date to realize those filters was through crossover circuits, at the input circuit 4. These crossover circuits are electronic circuits at the input of the balanced armature driver assembly, and which "cut" the audio signal in several bands, and feed each given band to one or more of the drivers of the assembly. However, crossover circuits are known to introduce singularities in the frequency response, and to create phase issues which are most of the time impossible to compensate.

Turning to FIG. 7, the Applicant has discovered that, by using a driver cabled according to FIG. 2, a high pass filter can be achieved. In order to do so, another 2389 receiver made by Sonion (registered trademark) having three taps referenced 22, 24 and 26 is connected to a 2389 driver having three taps referenced 12, 14 and 16. The two drivers are connected by wiring taps 12 and 22 together. The 2389 driver having taps 12, 14 and 16 is cabled according to FIG. 2 by shorting taps 14 and 16, and connecting them to the wire of the cabling 6 corresponding to the negative signal cable of the cabling 6. Tap 26 is also connected to the negative signal cable of the cabling 6, while tap 24 is connected to positive signal cable of the cabling 6.

FIG. 8 shows the difference of the frequency response of the 2389 driver having taps 12, 14 and 16 in a balanced armature assembly according to FIG. 7, and the frequency response of the same driver when cabled conventionally. This curve shows that the assembly of FIG. 7 acts as a high pass filter above 1 kHz on this 2389 driver.

FIG. 9 shows the impedance and phase frequency response of the driver assembly of FIG. 7, showing that it remains largely flat, the impedance varying from 5 ohms at 20 Hz to 10 ohms at 20 kHz, and the phase remaining nearly flat, between 0° and 15° at the maximum. This means that the balanced armature assembly will again not be output impedance sensitive.

FIG. 10 is similar to FIG. 7, except that the first 2389 driver has been replaced by a 2015 receiver by Sonion (registered trademark).

Furthermore, the electrical scheme is different in that:

taps 14 and 24 are wired (instead of 12 and 22), taps 12 and 16 are shorted (instead of 14 and 16), tap 26 is connected to the negative signal cable of the cabling 6, tap 22 and the shorted taps 12 and 16 are connected to the positive signal cable of the cabling 6.

As a result, a low pass filter is achieved at the 2015 driver output.

FIG. 11 shows the impedance and phase frequency response of the driver assembly of FIG. 10, showing that it remains largely flat, the impedance varying from 5 ohms at 20 Hz to 9 ohms at 20 kHz, and the phase remaining nearly flat, between 0° and 10° at the maximum.

FIG. 12 shows the difference of the frequency response of the 2015 driver in a balanced armature assembly according to FIG. 10 with the 2015 driver being cabled conventionally, and the frequency response of the 2015 driver in the balanced armature assembly of FIG. 10. This curve shows that the balanced armature assembly of FIG. 10 acts as a low pass filter under 1 kHz.

In the balanced armature assembly of FIG. 13, the first driver cabled according to FIG. 2 is a 2015 driver, and the second driver is a 2389 driver. FIG. 13 is similar to FIG. 10, except that:

tap 22 is connected to the negative signal cable of the cabling 6, taps 14 and 24 are connected (instead of taps 12 and 22), taps 12 and 16 are shorted and connected with tap 26 to the positive signal cable of the cabling 6, and a capacitor 28 is connected between the positive signal cable of the cabling 6 and the wire connecting taps 14 and 24.

As a result, a band-pass filter is achieved, as evidenced by FIG. 14.

FIG. 14 shows the frequency responses achieved at the output of the 2015 driver by using capacitors having respectively 2 μF value (highest curve), 50 μF value (middle curve), and 100 μF value. Here, the band-pass filter is achieved between 1 kHz and 2 kHz.

FIG. 15 shows the difference in frequency response between the higher and middle curve, thereby exhibiting the effect of the value of the capacitance on the low pass cutoff steepness.

FIG. 16 shows that this is achieved while maintaining a generally flat impedance (between 5 ohms at 20 Hz and 7 ohms at 20 kHz), and a flat phase (between 0° and 10°), which means that the balanced armature assembly will again not be output impedance sensitive.

FIGS. 17 and 18 show other generic schemes which have allowed achieving a high-pass filter.

On FIG. 17:

tap 22 is connected to the positive signal cable of the cabling 6, tap 26 is wired to tap 12, with a capacitor 28 in series between them, tap 24 is connected to negative signal cable of the cabling 6, and taps 14 and 16 are shorted and connected to the negative signal cable of the cabling 6.

FIG. 18 is identical to FIG. 7 except that a capacitor 28 has been put in series between taps 12 and 22 wired together.

The measurements of the Applicant have shown that a high pass filter is achieved at the driver having taps 12, 14 and 16 in the balanced armature assemblies of FIGS. 17 and 18.

FIG. 19 shows another generic scheme which has allowed achieving a low-pass filter.

On FIG. 19:

taps 26 and 14 are connected to the wire of the cabling 6 corresponding to the negative signal cable of the cabling 6, tap 22 is connected to the positive signal cable of the cabling 6, taps 12 and 16 are shorted and tap 24 is connected in series with a capacitor 28 to this short, and taps 12 and 16 are connected in series with a resistor 30 to the positive signal cable of the cabling 6.

The measurements of the Applicant have shown that a low pass filter is achieved at the driver having taps 12, 14 and 16 in the balanced armature assembly of FIG. 19.

Other balanced armature wirings may be envisioned, combining one or more of the above designs, and by introducing one or more resistor or capacitor in series with the positive tap or negative tap of the first or second driver, or by shorting the central tap and the negative tap of the first driver instead of the positive tap and the central tap.

What is described as shorting here may be realized by effectively shorting the taps via wire soldering, or by directly producing a driver incorporating said short.

The invention claimed is:

1. A balanced armature driver assembly, comprising a first balanced armature driver having an armature surrounded by a coil, said first balanced armature driver having two taps for connecting respective end points (12,14) of said coil to a cabling (6) having a positive signal cable and a negative signal cable, wherein the coil further comprises an intermediate point (16) which is electrically connected to one of said respective end points (12,14) such that the coil is shorted (16) between said intermediate point and said one of said respective end points (12,14).

2. The balanced armature driver assembly according to claim 1, further comprising a second balanced armature driver having an armature surrounded by a coil, said second balanced armature driver having three taps for connecting respective end points (22, 24) of said coil to the cabling (6); for connecting an intermediate point (26) to the cabling (6); or for connecting both respective end points (22, 24) of said coil and for connecting an intermediate point (26) to the cabling (6), wherein said first balanced armature driver and said second balanced armature driver are cabled such that a high pass filter is achieved at an output of the first balanced armature driver.

3. The balanced armature driver assembly according to claim 2, wherein the intermediate point (16) of the first balanced armature driver is electrically connected to the end point (14) which is connected to the negative signal cable of the cabling (6).

4. The balanced armature driver assembly according to claim 3, wherein the other end point (12) of the first balanced armature driver is wired to an end point (22) of the second balanced armature driver, wherein the intermediate point (26) of the second balanced armature driver is connected to the negative signal cable of the cabling (6), and wherein the other end point (24) of the second balanced armature driver is connected to the positive signal cable of the cabling (6).

5. The balanced armature driver assembly according to claim 4, further comprising a capacitor (28) placed in series between the other end point (12) of the first balanced armature driver and the end point (22) of the second balanced armature driver.

6. The balanced armature driver assembly according to claim 3, wherein the other end point (12) of the first balanced armature driver is wired to the intermediate point (26) of the second balanced armature driver with a capacitor (28) placed in series between them, wherein an end point (24) of the second balanced armature driver is connected to the negative signal cable of the cabling (6), and wherein the other end point (22) of the second balanced armature driver is connected to the positive signal cable of the cabling (6).

7. The balanced armature driver assembly according to claim 1, further comprising a second balanced armature driver having an armature surrounded by a coil, said second balanced armature driver having three taps for connecting respective end points (22, 24) of said coil to the cabling (6); for connecting an intermediate point (26) to the cabling (6); or for connecting both respective end points (22, 24) of said coil and for connecting an intermediate point (26) to the cabling (6), wherein said first balanced armature driver and said second balanced armature driver are cabled such that a low pass filter is achieved at an output of the first balanced armature driver.

8. The balanced armature driver assembly according to claim 7, wherein the intermediate point (16) of the first balanced armature driver is electrically connected to the end point (12) which is connected to the positive signal cable of the cabling (6).

9. The balanced armature driver assembly according to claim 8, wherein the other end point (14) of the first balanced armature driver is connected to an end point (24) of the second balanced armature driver, wherein the other end point (22) of the second balanced armature driver is connected to the positive signal cable of the cabling (6), and wherein the intermediate point (26) of the second balanced armature driver is connected to the negative signal cable of the cabling (6).

10. The balanced armature driver assembly according to claim 8, wherein the other end point (14) of the first balanced armature driver and the intermediate point (26) of the second balanced armature driver are connected to the negative signal cable of the cabling (6), wherein an end point (22) of the second balanced armature driver is connected to the positive signal cable of the cabling (6), and wherein the other end point (24) of the second balanced armature driver is connected in series with a capacitor (28) to the intermediate point (16) of the first balanced armature driver and the end point (22) which is connected to the positive signal cable of the cabling (6), a resistor (30) being further placed in series between the positive signal cable of the cabling (6) and the intermediate point (16) of the first balanced armature driver.

11. The balanced armature driver assembly according to claim 1, further comprising a second balanced armature driver having an armature surrounded by a coil, said second balanced armature driver having three taps for connecting respective end points (12,14) of said coil to the cabling (6); for connecting an intermediate point (26) to the cabling (6); or for connecting both respective end points (12, 14) of said coil and for connecting an intermediate point (26) to the cabling (6), wherein said first balanced armature driver and said second balanced armature driver are cabled such that a band pass filter is achieved at an output of the first balanced armature driver.

12. The balanced armature driver assembly according to claim 11, wherein an end point (22) of the second driver is connected to the negative signal cable of the cabling (6), wherein the intermediate point (16) of the first driver is electrically connected to the end point (12) which is connected to the positive signal cable of the cabling (6), wherein the intermediate point (26) of the second balanced armature driver is further connected to the positive signal cable of the cabling (6), and wherein the other end points (14, 24) of the first driver and the second driver are wired together and are connected to the positive signal cable of the cabling (6) with a capacitor (28) placed in series.

13. The balanced armature driver assembly according to claim 1, wherein the first driver has three taps each connected to one of the respective end points of the coil and the intermediate point, and wherein the electrical connection such that the coil is shorted (16) between said intermediate point and said one of said respective points (12, 14) is realized by electrical wiring of the corresponding taps.

14. The balanced armature driver assembly according to claim 1, wherein the first driver has two taps each connected to one of the respective end points of the coil, and wherein the electrical connection such that the coil is shorted (16) between said intermediate point and said one of said respective points (12, 14) is realized internally to the coil.

15. The balanced armature driver assembly according to claim 1, further comprising an input circuit (4) for an input signal, the positive signal cable and the negative signal cable of the cabling (6) being respectively coupled to a positive output and a negative output of the input circuit (4).

* * * * *